US007152432B2

(12) United States Patent
Wanner et al.

(10) Patent No.: US 7,152,432 B2
(45) Date of Patent: Dec. 26, 2006

(54) MULTISTORY BATH CONDENSER

(75) Inventors: Alfred Wanner, Munich (DE); Horst Corduan, Puchheim (DE); Dietrich Rottmann, Munich (DE); Karl Heinrich Schweigert, Munich (DE)

(73) Assignee: Linde AG, Weibaden (DE)

( * ) Notice: Subject to any disclaimer, the term of this patent is extended or adjusted under 35 U.S.C. 154(b) by 270 days.

(21) Appl. No.: 10/296,883

(22) PCT Filed: May 31, 2001

(86) PCT No.: PCT/EP01/06206

§ 371 (c)(1),
(2), (4) Date: Jun. 10, 2003

(87) PCT Pub. No.: WO01/92798

PCT Pub. Date: Dec. 6, 2001

(65) Prior Publication Data

US 2005/0028554 A1 Feb. 10, 2005

(30) Foreign Application Priority Data

Jul. 21, 2000 (EP) ..... 00115783
May 31, 2001 (DE) ..... 100 27 140

(51) Int. Cl.
*F25J 5/00* (2006.01)
*F25J 3/00* (2006.01)

(52) U.S. Cl. ..... 62/643; 62/620; 62/903

(58) Field of Classification Search ..... 62/643, 62/903, 620
See application file for complete search history.

(56) References Cited

U.S. PATENT DOCUMENTS 5,071,458 A * 12/1991 Grenier et al. ..... 165/166
5,144,809 A * 9/1992 Chevalier et al. ..... 165/166
5,148,858 A * 9/1992 Ovretveit ..... 165/282
5,222,549 A * 6/1993 Ishii et al. ..... 165/110
5,901,574 A * 5/1999 Rohde ..... 62/640
6,374,636 B1 * 4/2002 Thonnelier et al. ..... 62/643
6,393,864 B1 * 5/2002 Darredeau ..... 62/643

* cited by examiner

*Primary Examiner*—William C. Doerrler
(74) *Attorney, Agent, or Firm*—Millen, White, Zelano & Branigan, P.C.

(57) ABSTRACT

The invention relates to a bath condenser with a condenser block (1) that has evaporation passages (8) for a liquid and liquefaction passages (2) for a heating medium and at least two circulation sections (7) that are located vertically on top of one another. The evaporation passages (8) each have on the lower end of a circulation section (7) at least one entry opening (9) for the liquid and on the upper end of a circulation section (7) at least one exit opening (10), for each circulation section (7) there being a liquid storage tank (15) that is flow-connected to the entry opening (9) and the exit opening (10) of the circulation section (7) and that has a gas offtake (18). The inlet into the gas offtake (18) is not located in the area in front of the side (12) of the circulation section (7) in which the exit opening (10) of the circulation section (7) is located.

17 Claims, 5 Drawing Sheets

MULTISTORY BATH CONDENSER

Figure 1:
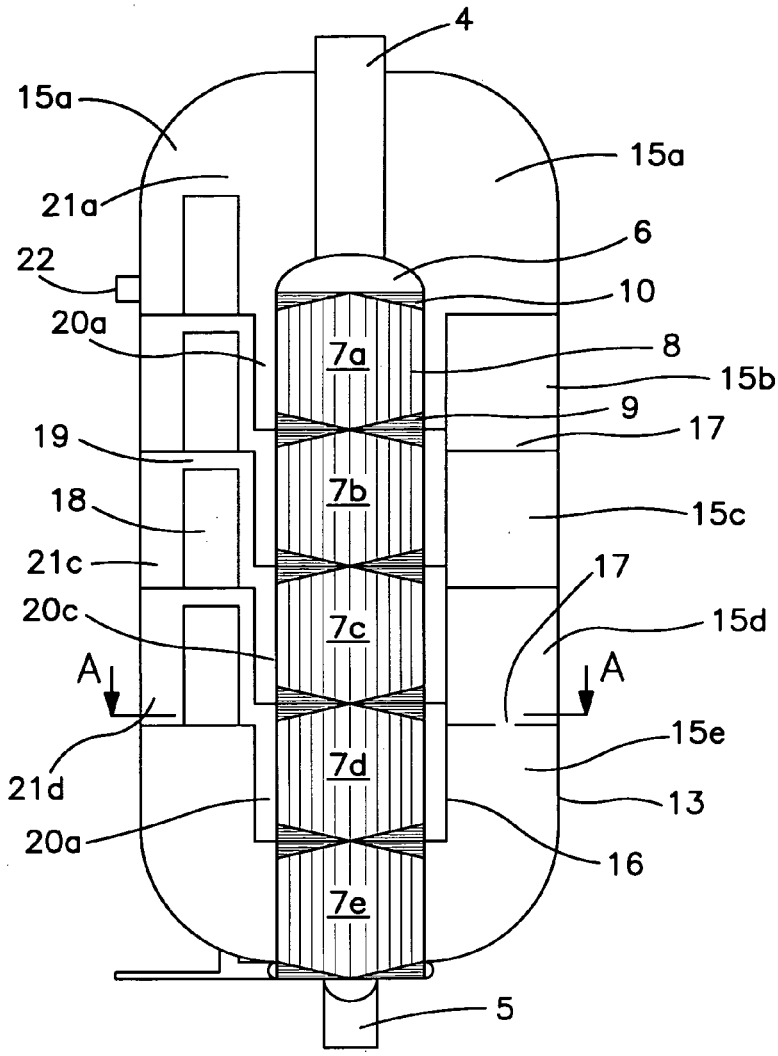

The invention relates to a bath condenser with a condenser block that has evaporation passages for a liquid and liquefaction passages for a heating medium and at least two circulation sections that are located vertically on top of one another, the evaporation passages each having on the lower end of a circulation section at least one entry opening for the liquid and on the upper end of the circulation section at least one exit opening, for each circulation section there being a liquid storage tank that is flow-connected to the entry opening and the exit opening of the circulation section and that has a gas offtake.

In a low-temperature air decomposition system with a pressure column and a low-pressure column, liquid oxygen from the low-pressure column is evaporated against gaseous nitrogen from the pressure column in indirect heat exchange in a heat exchanger, the nitrogen condensing.

The heat exchanger is implemented essentially in two different basic forms. In a falling-film evaporator, the liquid to be evaporated is delivered at the top to the evaporation passages via a distribution system that at the same time forms a gas seal. The liquid runs down as a liquid film over the heating surface, its being partially evaporated. The resulting gas and the unevaporated residual liquid emerge at the bottom from the falling-film evaporator. The liquid collects in the collecting space located under the condenser, while the gas portion is relayed on.

In a bath condenser, on the other hand, the condenser block is in the liquid bath from which liquid is to be evaporated. The liquid from underneath enters the evaporation passages of the condenser block and is partially evaporated against the heating medium that flows through the liquefaction passages. The density of the medium that is evaporating in the evaporation passages is less than the density of the surrounding liquid bath, resulting in a siphon action, so that the liquid from the liquid bath flows into the evaporation passages. The greater the immersion depth of the condenser block in the liquid bath, the higher the average hydrostatic pressure becomes in the evaporation passages and the more poorly the liquid evaporates, since the boiling point of the liquid rises according to the vapor pressure curve.

The efficiency of a bath condenser can therefore be increased by dividing the condenser block into several sections that are located on top of one another, hereinafter called circulation sections. The advantage of one such arrangement is that the immersion depth for several circulation sections is smaller than for a single high condenser block. Thus, the hydrostatic pressure in the evaporation passages becomes less and the liquid can evaporate more easily.

U.S. Pat. 5,775,129 discloses a combined falling-film bath condenser. In the upper area, in the manner of a falling-film evaporator, liquid oxygen, which flows downward, is partially evaporated. Underneath is a bath condenser that is divided into two circulating sections. The upper of the two circulating sections over its entire periphery is surrounded by a type of gallery that is used as a liquid storage tank for this circulation section. The walls of the gallery are drawn up somewhat farther than the top edge of the corresponding circulation section so that the gas emerging on the top end from the circulation section does not immediately leave the gallery, but first rises in the gallery that is open to the top. During this phase, liquid that is entrained by the gas is partially separated and collects in the liquid bath on the bottom of the gallery. The gallery that is shown with the separation area can only be implemented, however, when above the circulation section there is no other circulation section. Otherwise the entry openings of the circulation section located above the gallery are covered by the latter.

The object of this invention is therefore to develop a multistory bath condenser in which as little liquid as possible is entrained with the withdrawn gas.

This object is achieved by a bath condenser of the initially mentioned type, in which the inlet into the gas offtake is not located in the half-open volume next to the condenser block that is bordered by the side of the circulation section in which the exit opening of the circulation section is located and the half-planes that include one side edge at a time and that are aligned perpendicular to the side.

The phrase "circulation section" is defined as a section of the condenser block in which the function of a bath condenser or circulation evaporator is implemented.

As claimed in the invention, the bath condenser consists of at least two circulation sections that are located on top of one another and that are each supplied with liquid from its own liquid storage tank. The vertical subdivision of the bath condenser can greatly reduce the liquid level in the liquid storage tanks of the respective circulation sections relative to the liquid level in the single continuous condenser block.

The liquid enters the evaporation passages via the entry openings that are located on the bottom end of the circulation section, flows upward, partially evaporates and leaves the passages on the top end of the circulation section via suitable exit openings. The liquid portion in the liquid-gas mixture emerging from the passages flows, on the one hand, back to the entry openings of this circulation section, and, on the other hand, depending on the liquid level in the liquid storage tank of the circulation section, to the entry openings of the underlying circulation section in order to be overturned there in turn via the evaporation passages.

As claimed in the invention, the inlet into the gas offtake and the exit openings from the circulation section are spatially separated such that the liquid-gas mixture emerging from the circulation section is not routed directly into the gas offtake, but first must traverse a separation area. The separation area in its simplest embodiment can be a partially shielded volume or else can be provided with elements that force repeated deflection of the gas flow.

As claimed in the invention, the inlet into the gas offtake should not be located in the open half-volume in front of the side of the circulation section in which the exit opening is located. The half-volume is bordered by the side with the exit openings and generally by two vertical and two horizontal half-planes that each contain one edge of the circulation section. In other words: The inlet into the gas offtake should not be in the "shadow" of the circulation section in front of the side with the exit openings.

In this way, direct flow of the liquid-gas mixture out of the circulation section into the gas offtake is avoided. The liquid-gas mixture is deflected before entering the gas offtake, reducing the gas velocity and thus the amount of entrained liquid with the evaporated gas. Before the gas enters the gas offtake, effective separation of the liquid entrained with the gas flow is thus achieved. The liquid level in the liquid storage tank remains high such that proper operation of the circulation section is ensured. A sufficiently high liquid level is especially important in order to preclude complete evaporation of the liquid in the evaporation passages that could lead to shifting of the evaporation passages by high-boiling components.

The danger of entrainment of liquid can be advantageously reduced by the inlet into the gas line being located above the exit opening of the evaporation passages of the corresponding circulation section. The gas that has evaporated in the circulation section, before it enters the gas line, must be deflected upwards and rise a certain distance. The volume between the exit opening from the circulation section and the inlet into the gas line is used as an additional separation space in which the liquid entrained with the gas is separated from the gas flow.

The liquid storage tank is preferably implemented by a bottom that runs obliquely to the top, that is connected to the lower end of the circulation section, and that is bordered by suitable side walls so that a wedge-shaped volume is formed. The bottom that runs obliquely to the top extends to beyond the top end of the circulation section and above the circulation section has an outlet to a gas offtake. The volume above the circulation section is used as the separation space.

Instead of the oblique bottom, it is especially advantageous to attach a sheet that has been buckled in a step-shape to the bottom edge of the circulation section. The sheet runs proceeding from the bottom end of the circulation section first horizontally, then vertically up, then again horizontally and finally vertically. Two sheets that have been folded in this way form a first pocket that directly borders the circulation section and that represents the liquid storage tank. Preferably the sheets are folded such that the vertical component piece of the sheet that represents the border of the liquid storage tank extends as far as the height of the exit openings from the circulation section.

The intermediate space between the two "steps" of the sheets that have been folded in a step-shape forms an additional pocket that is offset to the top against the liquid storage tank, that is used as a separation space and that is connected to the liquid storage tank via a gap-like opening.

In another favorable embodiment, the inlet into the gas offtake is not located on the side of the condenser block that has the exit openings from the evaporation passages. It is possible to provide the inlet into the gas offtake in the area in front of the side opposite the gas exit side or preferably in the area in front of the side adjacent to the gas exit side. The liquid-gas mixture is also deflected in these arrangements before it enters the gas offtake, by which the liquid is separated more easily from the gas.

The gas inlet is especially preferably located offset both laterally and also to the top against the exit openings.

Preferably at most two sides of the condenser block are provided with entry and/or exit openings. In this case the inlet into the gas offtake is advantageously located above the circulation section. The areas in front of the two other vertical sides of the condenser block can then be kept free of piping and other components so that the bath condenser can be built to be relatively compact.

In one especially preferred embodiment, on the two opposing sides of the condenser block there are entry and exit openings to the evaporation passages. In this case, it is especially advantageous if the condenser block is built mirror-symmetrically to the center plane between these two sides.

A more compact execution of the bath condenser can be achieved by all entry and exit openings being located on the same side of the heat exchanger. Lines to connect the entry and exit openings to one another and the liquid storage tanks are only necessary on the outside of the condenser block.

For reasons of production technology, however, it can also be advantageous if the entry openings into the evaporation passages of a circulation section and the exit openings from the evaporation passages of the underlying circulation section are located on opposite sides of the condenser block. If for the condenser block the connections of the entry opening or the exit opening to the respective evaporation passages are implemented by obliquely running plates, one section of the condenser block can be divided diagonally into a transition zone from the entry opening to the evaporation passages of the upper circulation section and into a transition zone from the passages to the exit opening of the lower circulation section. The structural height of the condenser block can thus be reduced.

If the inlet into the gas offtake is located above the circulation section, it is advantageous if the side of the circulation section in which the entry and exit openings are located is provided with a collector that has one liquid feed line and one gas offtake. A circulation section generally has rectangular side walls. The collector covers at least the entry and exit openings of the side wall of the circulation section, but preferably the entire side wall of the circulation section. The walls of the collector and the side wall of the circulation section therefore form a volume that is shielded against the environment and that is gastight and liquid-tight except for the feed lines and offtake that are intended for this purpose.

The bath condenser in this variant is bordered laterally by the side walls of the condenser block, or on the sides on which the entry and/or exit openings are located, by the outside walls of the collector. A separate tank around the bath condenser is not necessary, by which the condenser becomes extremely compact. In this way, material for the tank wall is saved and the entire length of the welds necessary for production is greatly reduced, by which production is simplified. Moreover, for the collector smaller wall thicknesses can be selected than for the otherwise necessary tank wall, since the diameters of the collectors need not be made as large as that of a tank around the condenser block. This saves considerable costs.

In the arrangement of the inlet into the gas offtake above the circulation section, it has been found to be especially advantageous to cover the sides of several circulation sections, especially the entire side of the condenser block in which the entry and exit openings are located, with a collector that is provided with a liquid feed line and gas offtake. In this collector, for each circulation section there is a suitable liquid storage tank.

Preferably the condenser block has a rectangular section and is placed in a round tank. The round tank contains the liquid storage tank and the lines for routing liquid from one circulation section to the adjacent circulation section and the necessary gas offtakes. The gas offtake and the inlet into the gas offtake and the liquid lines are preferably located in the ring area between the condenser block and the tank wall in front of a side of the condenser block that is adjacent to the block side with the exit opening. The liquid-gas mixture that leaves the circulation section must be routed along the annulus around the condenser block, the liquid separating from the mixture.

Preferably the collector or the tank on the boundary of two circulation sections is divided into stages, two adjacent stages being connected to one another on the flow side via one liquid and one gas line. The collector or tank that extends over the height of several circulation sections, preferably over the entire height of the condenser block, is divided into stages according to the circulation sections. The stages are delineated against one another preferably by flat sheets or elbowed bottoms. It is especially advantageous if the individual stages are delineated gastight and liquid-tight against one another except for flow connections that are intended especially for this purpose so that the volume of one stage can be used as the liquid storage tank for the bordering circulation section.

Liquid transport from one stage to the underlying stage is advantageously ensured via an overflow pipe. The bottom of the stage is penetrated by an overflow pipe with an opening located above the bottom. The liquid that flows into this stage from the circulation section collects on the bottom of the stage and drains into the underlying stage only when the liquid level has reached the height of the opening of the overflow pipe. At a lower liquid level, the liquid is overturned only in the upper of the two stages.

It has proven especially advantageous to provide the gas inlet of the gas line on the side that faces away from the exit opening of the evaporation passages. The gas that emerges from the exit opening is then deflected again in the stage before it enters the gas line, by which the liquid is more easily separated from the gas flow.

The liquid or gas lines that connect two stages to one another or that discharge gas from one stage run preferably within the collector or within the tank. Especially preferably both the liquid and also the gas line are housed within the collector. The bath condenser therefore remains extremely compact.

Preferably there is one gas line that extends through all stages and that has one gas inlet in each stage.

The bath condenser as claimed in the invention can be advantageously used especially as the main condenser of a low-temperature air decomposition system.

Figure 2:
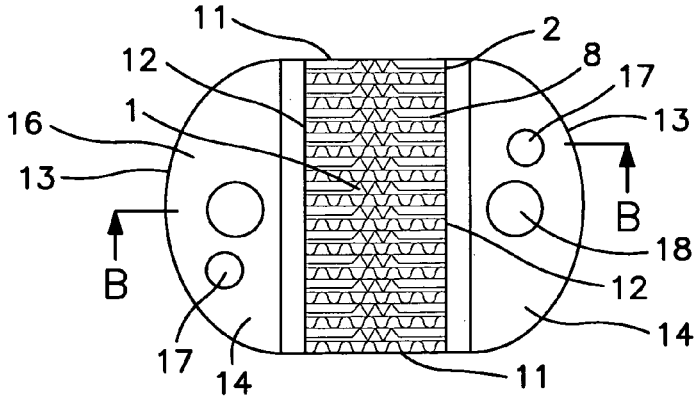
Figure 3:
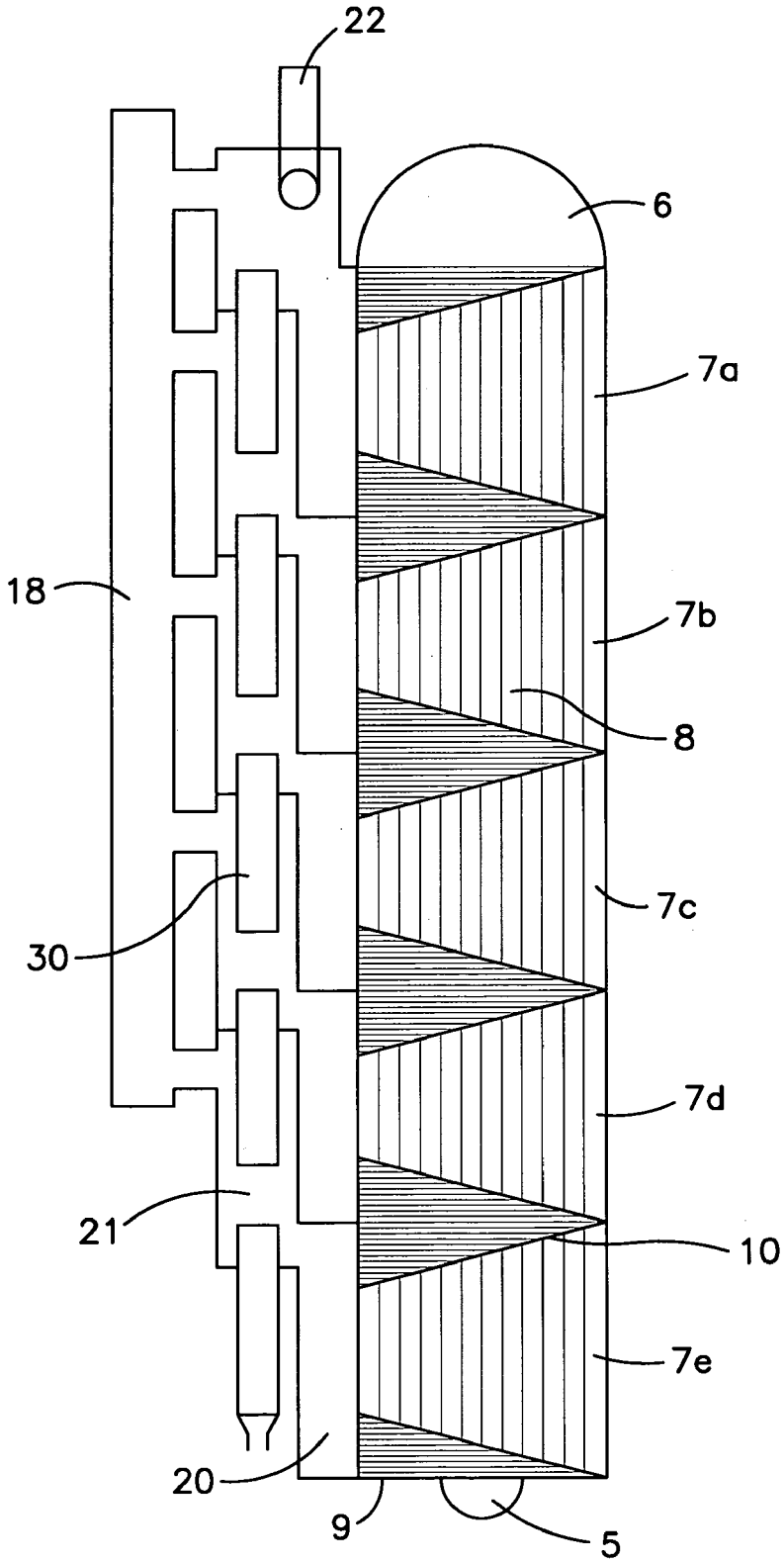
Figure 4:
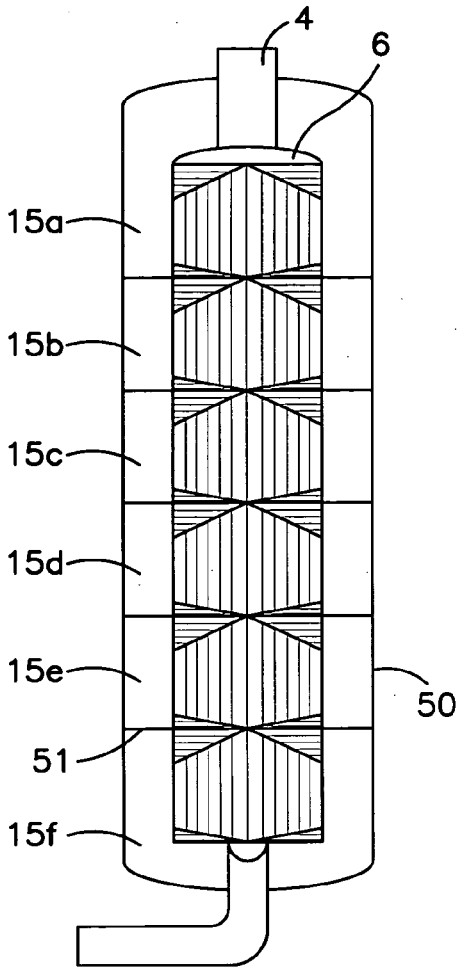
Figure 6:
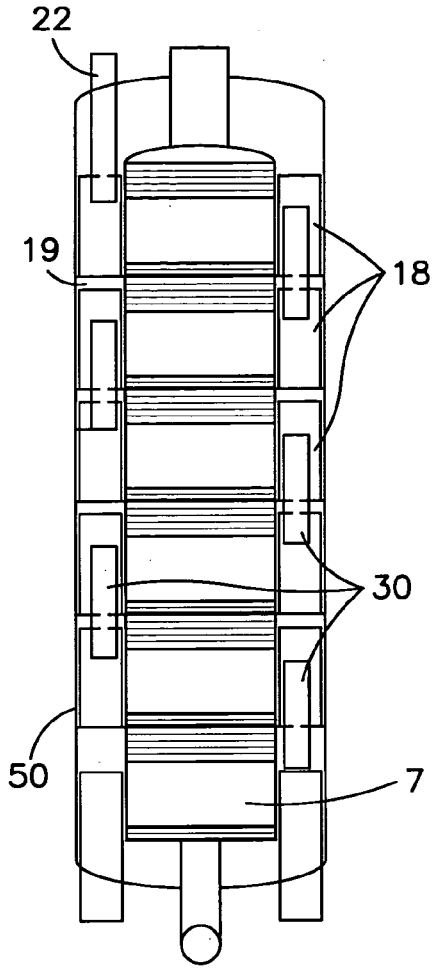
Figure 5:
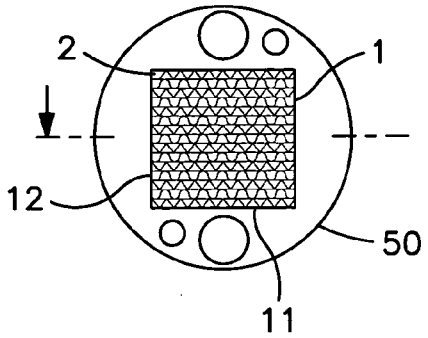
Figure 7:
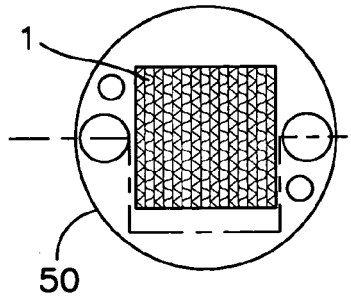
Figure 8:
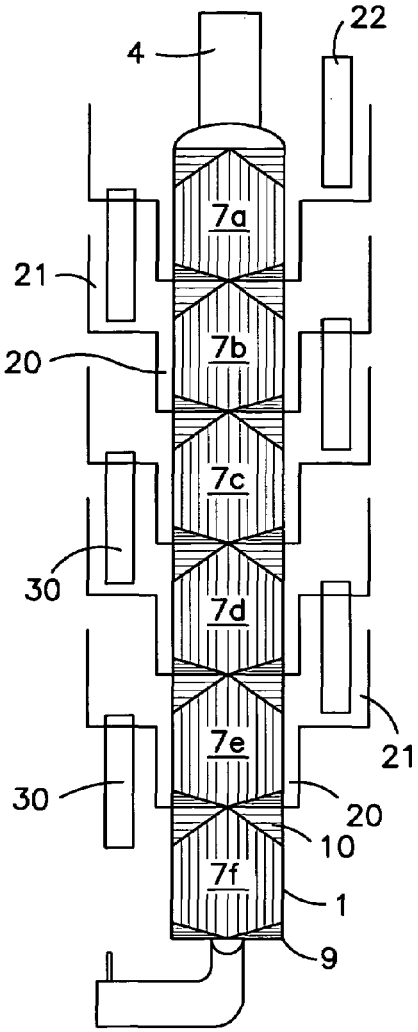
Figure 10:
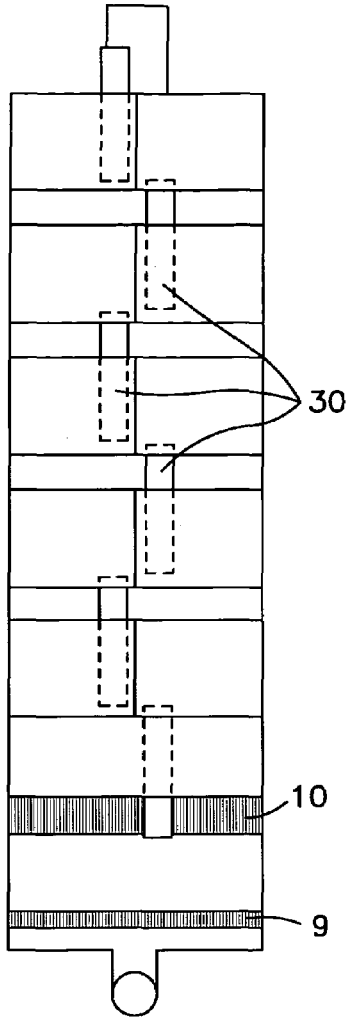
Figure 11:
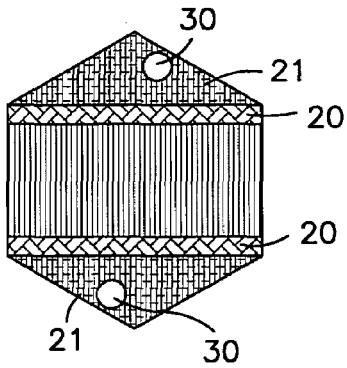
Figure 12:
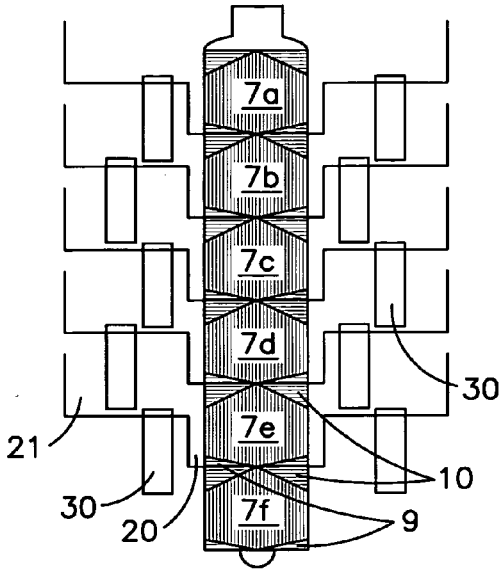
Figure 13:
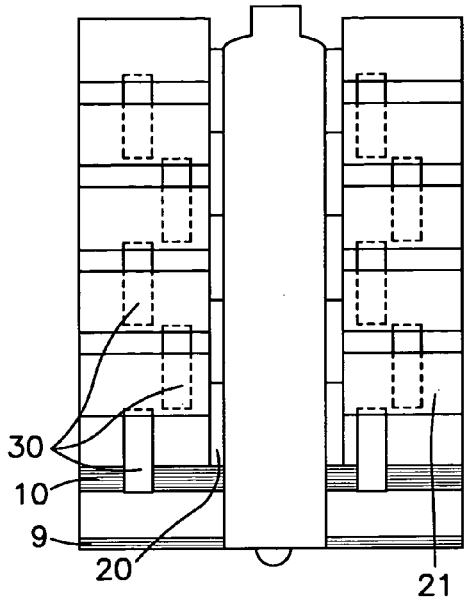
Figure 14:
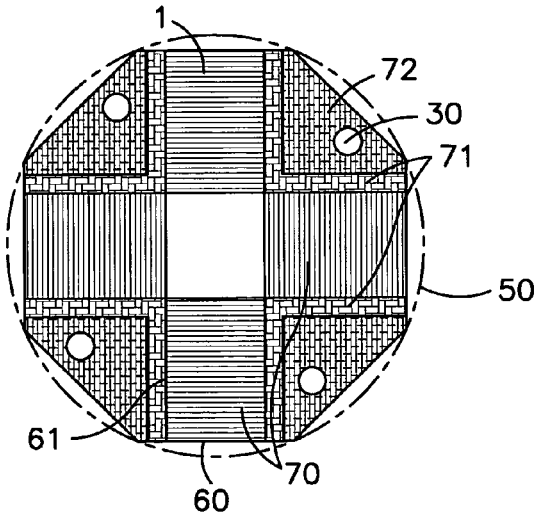

The invention and other details of the invention are detailed below using the embodiments shown in the drawings. Here:

FIG. 1 shows a section through a bath condenser as claimed in the invention along line B—B in FIG. 2, FIG. 2 shows a section through the same bath condenser along line A—A in FIG. 1, FIG. 3 shows a section through another embodiment of the invention, FIGS. 4 to 7 show different sections through a bath condenser as claimed in the invention with a round tank, FIGS. 8 to 11 show an alternative embodiment of the bath condenser with a round tank, and FIGS. 12 to 14 show another version of the bath condenser as claimed in the invention with a round tank.

FIGS. 1 and 2 show two sections through a bath condenser as claimed in the invention that is used as the main condenser of a double column of an air decomposition system. The main condenser can be located either in the low-pressure column of the double column or preferably outside the double column. FIG. 1 shows a section along line B—B in FIG. 2, and FIG. 2 shows a section along line A—A of FIG. 1. The bath condenser consists of a condenser block 1 that contains a host of heat exchange passages 2, 8 that run parallel and in which gaseous nitrogen is condensed in heat exchange with liquid oxygen, the oxygen being evaporated.

The nitrogen passages 2 extend over the entire height of the condenser block 1. Gaseous nitrogen is supplied via a feed line 4 to the nitrogen passages 2 and is withdrawn as the liquid on the bottom end of the block 1 via the line 5. Distribution of the gaseous nitrogen among the nitrogen passages 2 takes place via a collector/distributor 6 that is connected to the condenser block 1. The liquid nitrogen that emerges from the heat exchange passages of the condenser block 1 is analogously funneled into the drain line 5.

The oxygen passages 8 do not extend, in contrast to the nitrogen passages 2, over the entire length of the condenser block 1, but are divided into 5 circulation sections 7i a to 7*e*. Each circulation section 7*a–e* is built mirror-symmetrically to the center plane of the condenser block 1 which runs vertically. Each of these two symmetrical halves consists of heat exchange passages 8 that adjoin the passages 9, 10 that run horizontally on the top and bottom end of the circulation section 7 and that are used for delivery and drainage of the liquid and gas into the oxygen passages 8. The entry and exit passages 9, 10 of the two symmetrical halves of a circulation section 7 each end on the same side of the condenser block 1.

The circulation sections 7*a* to 7*e* are all built identically. The condenser block 1 thus has two sides that are closed by one termination sheet 11 at a time and two opposing sides 12 in which for each circulation section 7*a–e*, there is one entry opening 9 for liquid oxygen and one exit opening 10 for partially evaporated oxygen.

Half-cylinder shells 13 that cover all side surfaces 12 are connected to the two sides 12 of the condenser block 1 that are provided with entry and exit openings 9, 10. The half-cylinder shells 13 end with the vertical edges of the cuboidal condenser block 1. The two spaces 14 that are bordered by the side walls 12 and the half-cylinder shells 13 and that are located on opposing sides of the condenser block 1 are not connected to one another over the run of the height of the condenser block 1. The sole connection between the two spaces 14 is above the condenser block 1, since the half-cylinder shells 13 are higher than the condenser block 1 and are connected to one another in the area above the condenser block 1. The bath condenser therefore consists of a condenser block 1 that adjoins the two half-cylinder shells 13 on both sides and of a head part 21 a that spans the condenser block 1 and the two half-cylinder shells 13.

The spaces 14 bordered by the half-cylinder shells 13 are subdivided by sheets 16 into several stages 15*a* to 15*e*. The sheets 16 extend from the border between two circulation sections 7 to the half-cylinder shell 13 that is located on this side of the condenser block 1. In the sheets 16 there are drain openings 17 through which liquid oxygen can drain from one stage, for example 15*b*, into the underlying stage, for example 15*c*. Furthermore, gas shafts 18 that extend from one sheet 16 to barely underneath the sheet 16 that lies overhead are connected to the sheets 16.

The gas shafts 18 are arranged in a line and thus form essentially a common gas collecting line, but between the top end of each gas shaft 18 and the overlying sheet 16 a gap 19 remaining that enables entry of gas from the respective stage 15 into the gas collecting line. The sheets 16 run at least partially rising so that the annular gap 19 is above the exit openings 10 of the respective stage 15.

In the example shown in FIG. 1, the sheets 16 are folded twice at a right angle so that between two sheets 16 a stage 15 is formed that consists of two spaces 20, 21 that are connected to one another. The space 20*c* is located at the height of the pertinent circulation section 7*c* and is used as a liquid storage tank. The second space 21*c* is conversely almost at the same height as the next higher circulation section 7*b* and forms a type of additional pocket that is offset above and laterally to the liquid storage tank 20*c*.

In the operation of the bath condenser, liquid oxygen is delivered to the two uppermost stages 15*a* via the line 22. The oxygen collects first in the storage tank 20*a*, enters the oxygen passages 8 via the entry passages 9, is partially evaporated in indirect heat exchange with nitrogen and leaves the condenser block 1 as a liquid-gas mixture via the exit passages 10 in order to collect again in the storage tank 20. When the liquid level in the storage tank rises to the height of the exit channels 10, liquid oxygen can flow via the connecting gap into the second space 21*a* that is used as a separation space.

The separation space 21 a in its bottom has drain openings 17 through which excess liquid oxygen can flow from the stage 15*a* into the underlying stage 15*b*. In this case, the drain openings 17 of two adjacent stages 15 are arranged offset to one another so that for example oxygen dripping from the stage 15*b* does not continue to flow directly into stage 15*d*, but remains first in the stage 15*c*.

The drain openings 17 are preferably located as high as the exit openings 10 of the pertinent stage 15. It has proven advantageous to immerse the individual circulation sections 7 of the bath condenser in the liquid bath at least to such an extent that the liquid level in the storage tank 20 is at least barely underneath the bottom edge of the exit openings 10. In this way, complete evaporation in the evaporation passages 8 is precluded and shifting of the passages 8 by high-boiling components is prevented.

The oxygen draining into the stage 15*b* collects again in the storage tank 20*b*, is overturned in the circulation section 7*b* and partially evaporated. Excess liquid in the storage tank 20*b* runs via the drain opening 17 into the stage 15*c*. The oxygen gas that forms during evaporation in the circulation section 7 flows with the liquid oxygen out of the exit openings 10 and is discharged via the gas shaft 18. These processes repeat in each stage 15.

The oxygen gas is repeatedly deflected by the arrangement of the separation space 21 that is offset laterally and to the top and the annular gas inlet 19 into the gas shaft 18 before it is discharged from a stage 15. In these deflections the flow velocity of the gaseous oxygen is lowered so dramatically that the latter does not entrain any still liquid oxygen or hardly any. In the separation space 21, therefore, very good liquid-gas separation is achieved. The oxygen gas rising through the gas shafts 18 is discharged at the top end of the bath condenser via an oxygen discharge line that is not shown in the drawings.

FIG. 3 shows another embodiment of the bath condenser as claimed in the invention, in which the oxygen passages 8 have entry and exit openings 9, 10 only on one side of the condenser block 1. The nitrogen passages that are not shown correspond to the passages 2 in FIG. 2 and extend likewise over the entire height of the condenser block. The nitrogen gas that is to be condensed and that is used as the heat transfer medium is distributed via the collector/distributor 6 into the nitrogen passages and on the lower end of the condenser block 1 is funneled into a collector 5 as liquid and removed.

On the oxygen side, the condenser block 1 is divided into five circulation sections 7*a* to 7*e* that each have one entry and one exit area 9, 10 with horizontally running plates and the actual heat exchange area 8 with vertical channels. All entry openings 9 and exit openings 10 lie on the same side of the condenser block 1.

On the open side 12 of the condenser block 1, there are likewise liquid storage tanks 20 and separation spaces 21. The liquid drains between the stages 15 via overflow pipes 30. The top edge of the overflow pipes 30 is at the same height with the top edge of the pertinent circulation section 7. This results in that the oxygen passages 8 and the corresponding entry and exit passages 9, 10 are always completely in the liquid bath. The evaporation passages 8 are always filled with liquid, by which shifting of the passages 8 by high-boiling components becomes absolutely impossible. Research has shown that a liquid level barely underneath the exit openings 9 reliably prevents such shifting of the passages 8.

FIGS. 4 to 7 show a multistory bath condenser that is used as the main condenser of a rectification column of an air decomposition system. In the bath condenser, gaseous nitrogen from the head of the pressure column and liquid oxygen from the bottom of the low-pressure column are brought into indirect heat exchange, the nitrogen condensing and the oxygen being evaporated.

The bath condenser has a cuboidal condenser block 1 that is surrounded by a round tank 50. The gaseous nitrogen is supplied at the head of the bath condenser via a feed line 4. A collector/distributor 6 uniformly distributes the nitrogen gas among the liquefaction passages 2 that extend over the entire height of the condenser block 1. On the bottom end of the condenser block 1, the condensed nitrogen is withdrawn via the line 5.

The liquid oxygen to be vaporized is supplied to the bath condenser via the line 22. The oxygen passages 8 are divided into several circulation sections 7 in which in each case partial evaporation of the oxygen takes place. Excess liquid oxygen is routed via overflow pipes 30 into the next lower circulation section, and the resulting oxygen gas is withdrawn by means of a gas collecting pipe 18. The structure and manner of operation of the condenser block 1 correspond in this respect exactly to the condenser block explained using FIGS. 1 and 2.

Instead of the half-cylinder shells 13, in this embodiment there is a tank 50 around the condenser block 1. The tank 50 is divided into stages 15 on the boundary surface between two circulation sections 7 by flat sheets 51. The middle stages 15*a–e* each form an annulus around the pertinent circulation section 7*b–e*. Only the uppermost stage 15a and the lowermost stage 15*f* can have a somewhat greater height than the respective circulation section 7*a*, 7*f*.

In contrast to the bath condensers of FIGS. 1 to 3, the liquid offtakes 30 and the gas offtakes 18 are not located on one of the condenser block sides 12 in which there are the entry and exit openings 9, 10 of the evaporation passages 8, but in the annulus 15 relative to the closed block sides 1 1. The gas collecting pipes 18 of the individual stages 15 are arranged in a line so that the oxygen that forms in each stage 15 can be discharged via a common line 18. Intake into the gas collecting line 18 takes place via the annulus opening 19.

The gaseous oxygen can flow down in the gas collecting line 18 and is then removed at the bottom via the line 52 to the bath condenser. Excess liquid that is not evaporated in the circulation sections 7 can flow together with the oxygen gas via the gas collecting line 52 out of the lowermost stage 15*f*.

The gaseous oxygen can, however, also flow upward within the gas collecting line 18. This is especially advantageous when the cylindrical tank 50 and the rectification column that holds the evaporated oxygen form a structural unit. Excess liquid that has not been vaporized in the bath condenser is then quantitatively withdrawn from the lowermost stage 15*f* as liquid product so that the theoretical liquid level in the lowermost stage 15*f* is kept constant.

The overflow pipes 30 for transfer of liquid from one stage 15 to the underlying stage 15 are located next to the gas collecting line 18 that is located in the middle in front of the condenser block side 11. The overflow pipes 30 are offset against one another from stage to stage, i.e., once to the right and once to the left from the gas offtake 18. Liquid oxygen therefore cannot continue to flow from one overflow pipe 30 directly into the next overflow pipe 30.

FIGS. 8 to 11 show various views of another embodiment of the bath condenser as claimed in the invention. The evaporation passages are in turn divided into several circulation sections 7 and liquid storage tanks 20 are attached to the condenser block 1 at the height of the circulation sections 7*a–e*. The storage tanks 20 adjoin separation tanks 21 that are offset laterally and to the top. On the liquid side, two adjacent circulation sections 7 at a time are connected by overflow pipes 30. The structure of the bath condenser corresponds in this respect essentially to the bath condenser as shown in FIG. 3, the entry and exit openings 9, 10 of the evaporation passages 8, however, being located on two opposing sides of the condenser block 1 and not all on the same side of the block 1.

Figure 9:
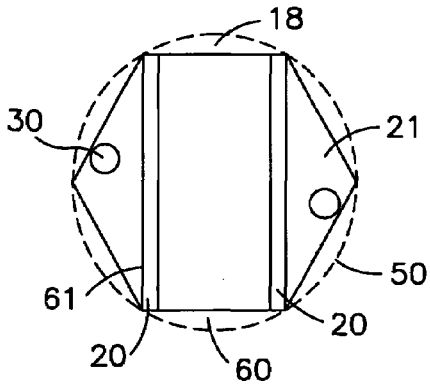

As can be seen in FIGS. 9 and 11, the condenser block 1 with the liquid storage tanks 20 and the separation spaces 21 in an overhead view form a hexagon, preferably an essentially equal-sided hexagon. The condenser block 1 has a right-angled cross section, the side 60 that is parallel to the sheets that separate the evaporation passages 8 from the liquefaction passages being clearly shorter than the side 61 that is oriented perpendicular to the sheets. The longer side 61 thus corresponds to the stack height of the sheets. To reach the necessary stack height, it can be quite advantageous to design the condenser block 1 as a combination of several individual blocks.

At the height of each circulation section 7, a liquid storage tank 20 is connected to the condenser block 1. Only the lowermost circulation section 7f does not require a storage tank since it is located in the bottom bath of the pertinent separation column or of a separate tank 50. The liquid storage tank 20 is preferably designed as a small cuboidal pocket that is attached laterally to the pertinent circulation section 7 and covers at least the entry openings 9 of the circulation section 7. The small size of the liquid storage tank 20 keeps its weight low in the filled state so that high demands need not be imposed on the stability of the storage tank 20. Moreover, in this way more space is available for the separation space 21.

The separation space 21 is offset laterally and to the top relative to the storage tank 20. The cross section of the separation space 21 appears in an overhead view roughly as an isosceles triangle. The two legs have the length of the aforementioned equilateral hexagon. In this version, the use of the circular cross section of the tank 50 in which the condenser block 1 is located, which use is good at little structural cost, is advantageous.

The intermediate spaces 18 between the hexagonal body that is formed by the block 1 and the separation space 21 and the cylindrical tank 50 are used as gas offtakes 18. The inlet into the gas offtakes 18 is located, as can be easily recognized in FIG. 8, above the exit openings 10 of the respective circulation section 7.

In another version of the invention that is explained below using FIGS. 12 to 14, four identical blocks 70 with the pertinent liquid storage tanks 20 and the pertinent separation spaces 21 form an octagon that is almost equilateral in outline. The stack height 61 of the individual blocks 70 is in turn higher than its width 60. Two blocks at a time are located at the distance of the sheet width 60 relative to one another so that the blocks 70 in an overhead view form a cross, in the center of which a square with the side length of the sheet width 60 remains free.

Four liquid storage tanks 71 that are L-shaped in cross section on the outside of the cross supply the four circulation sections 7 that are located at the same height with the liquid that is to be evaporated, each storage tank 71 being connected to two blocks 70. The lowermost circulation sections 7*f* are conversely supplied with liquid from the bottom of the column or of the tank in which the bath condenser is located.

The pertinent separation space 72 in cross section has approximately the same shape of a triangle with legs formed by the outer side of the L-shaped liquid storage tank 71 and with a base formed by one side of the octagon. The good use of the circular cross section with small structural cost is advantageous in this arrangement.

The liquid is routed by a circulation section 7 to the underlying circulation section 7 again via an overflow pipe 30. The intermediate space between the octagonal body and the cylindrical wall of the tank 50 in which the bath condenser is located is used as a gas offtake 18.

The invention claimed is:

1. Bath condenser with a condenser block that has evaporation passages for a liquid and liquefaction passages for a heating medium and at least two circulation sections that are located vertically on top of one another, the evaporation passages each having on the lower end of a circulation section at least one entry opening for the liquid and on the upper end of the circulation section at least one exit opening, for each circulation section there being a liquid storage tank that is flow-connected to the entry opening and the exit opening of the circulation section and that has a gas offtake, wherein, for at least one circulation section, the inlet into the gas offtake (18) is not located in a volume horizontally adjacent to the condenser block (1), the volume being bordered, horizontally, by the side (12) of the circulation section (7) in which the exit opening (10) of that circulation section (7) is located and extending horizontally away from the condenser block, and, vertically, by sheets (16) that are aligned perpendicular to the side (12) of the circulation section and aligned to the top and bottom of the circulation section.

2. Bath condenser according to claim 1, wherein the inlet into the gas offtake (18) is located above the volume horizontally adjacent to the condenser block.

3. Bath condenser according to claim 2, wherein the inlet into the gas offtake (18) is located at the height of the overlying circulation section (7).

4. A bath condenser according to claim 1, wherein the inlet into the gas offtake (18) is located in a volume horizontally adjacent to the condenser block (1) that is bordered by a side (11) of the condenser block (1) that has no entry opening or exit opening, and by two sheets that each include one vertical edge of the side (11) and that are aligned perpendicular to the side (11) of the circulation section and aligned to the top and bottom of the circulation section.

5. A bath condenser according to claim 1, wherein the inlet into the gas offtake (18) is located in a volume horizontally adjacent to the condenser block (1) that is bordered by the side of the condenser block (1) opposite the side (12) of the circulation section (7) in which the exit opening (10) of the circulation section (7) is located, and by two half-planes that each include one vertical edge of the opposite side and that are aligned perpendicular to the opposite side of the circulation section and aligned to the top and bottom of the circulation section.

6. A bath condenser according to claim 1, wherein at most two sides (12) of the condenser block (1) are provided with entry (9) and/or exit openings (10).

7. A bath condenser according to claim 6, wherein all entry (9) and exit openings (10) are located on the same side (12) of the condenser block (1).

8. A bath condenser as claimed in claim 1, wherein a collector (13) with a liquid feed line (22) and a gas offtake (18) that is horizontally adjacent to at least two circulation sections (7) is attached to one side (12) of the condenser block (1) in which the entry (9) and/or exit openings (10) are located.

9. Bath condenser according to claim 8, wherein the collector (13) horizontally adjacent to at least two circulation sections (7) is divided into stages (15), two adjacent stages (15) being connected to one another via one liquid line (17, 30) and one gas line (18) on the flow side.

10. Bath condenser according to claim 9, wherein two adjacent stages (15) are connected to one another via an overflow pipe (30) for liquid transport.

11. A bath condenser according to claim 1, wherein the condenser block has a rectangular cross-section and is located in a round tank.

12. A bath condenser according to claim 1, wherein the condenser block (1), liquid storage tanks (20) and separation spaces (21) that are connected to the liquid storage tanks (20) form in a plan view, a hexagon.

13. A bath condenser according to claim 1, wherein the condenser block (1), liquid storage tanks (20) and separation spaces (21) that are connected to the liquid storage tanks (20) form in a plan view, an octagon.

14. In an air separation system comprising a high pressure column, low pressure column and a main condenser for vaporizing oxygen in the low pressure column and liquefying nitrogen in the high pressure column, the improvement wherein the main condenser is in accordance with claim 1.

15. A method of separating air, comprising fractionating air in a system according to claim 14.

16. A bath condenser of claim 8, wherein the collector (13) with a liquid feed line (22) and a gas offtake (18) is horizontally adjacent to the entire side (12) of the condenser block (1) in which the entry (9) and/or exit openings (10) are located.

17. A bath condenser of claim 1, wherein the path from the exit opening to the gas offtake inlet is deflected at least once such that liquid entrained in a gas-liquid mixture along such path is separated more easily from the gas.

* * * * *